US009909584B2

(12) United States Patent
Simoni et al.

(10) Patent No.: US 9,909,584 B2
(45) Date of Patent: Mar. 6, 2018

(54) LUBRICANT VANE PUMP

(71) Applicant: PIERBURG PUMP TECHNOLOGY GMBH, Neuss (DE)

(72) Inventors: Mirco Simoni, Livorno (IT); Nicola Celata, Livorno (IT); Maurizio Moriglia, Pisa (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 79 days.

(21) Appl. No.: 14/653,271

(22) PCT Filed: Dec. 20, 2012

(86) PCT No.: PCT/EP2012/076420
§ 371 (c)(1),
(2) Date: Jun. 18, 2015

(87) PCT Pub. No.: WO2014/094860
PCT Pub. Date: Jun. 26, 2014

(65) Prior Publication Data

US 2015/0330388 A1 Nov. 19, 2015

(51) Int. Cl.
*F04C 2/344* (2006.01)
*F04C 14/10* (2006.01)

(52) U.S. Cl.
CPC ..... *F04C 2/3442* (2013.01); *F04C 14/10* (2013.01); *F04C 2210/206* (2013.01)

(58) Field of Classification Search
CPC ..... F04C 14/10; F04C 2/3442; F04C 14/26; F04C 15/06; F04C 15/0049; F04C 2270/185; F04C 2/3448; F01M 1/16
(Continued)

(56) References Cited

U.S. PATENT DOCUMENTS 4,780,069 A * 10/1988 Dantlgrabe et al. .... B23B 51/05 418/26
5,562,432 A * 10/1996 Semba ..... F04C 14/226 417/220

(Continued)

FOREIGN PATENT DOCUMENTS

CN 101044322 A 9/2007
CN 101566150 A 10/2009

(Continued)

*Primary Examiner* — Mark Laurenzi
*Assistant Examiner* — Anthony Ayala Delgado
(74) *Attorney, Agent, or Firm* — Norman B. Thot

(57) ABSTRACT

A lubricant vane pump for providing a pressurized lubricant for an internal combustion engine includes a pump housing enclosing a pumping cavity comprising a charge zone and a discharge zone. A shiftable control ring envelops the pumping cavity. A pump rotor comprising vanes divides the pumping cavity into pumping chambers. The pump rotor is radially slidable and rotates in the control ring from the charge zone to the discharge zone. A spring chamber comprises a pretensioning element which pushes the control ring to a high pumping volume direction. A control chamber is configured so that a lubricant pressure in the control chamber moves the control ring to a low pumping volume direction against a force of the pretensioning element. A pumping cavity outlet port is connected to the control chamber. A pressure equilibration channel drains the lubricant from the pumping chamber in the discharge zone into the spring chamber.

8 Claims, 1 Drawing Sheet

(58) Field of Classification Search
USPC ..... 418/22
See application file for complete search history.

(56) References Cited

U.S. PATENT DOCUMENTS

| | | | |
|---|---|---|---|
| 2006/0104823 | A1 | 5/2006 | Hunter et al. |
| 2007/0231161 | A1 | 10/2007 | Williamson |
| 2009/0269232 | A1 | 10/2009 | Williamson et al. |

FOREIGN PATENT DOCUMENTS

| | | | | |
|---|---|---|---|---|
| EP | 1 790 855 | A2 | 5/2007 | |
| WO | WO 2005026553 | A1 * | 3/2005 | ..... F04C 2/3442 |
| WO | WO 2006/032132 | A1 | 3/2006 | |

* cited by examiner

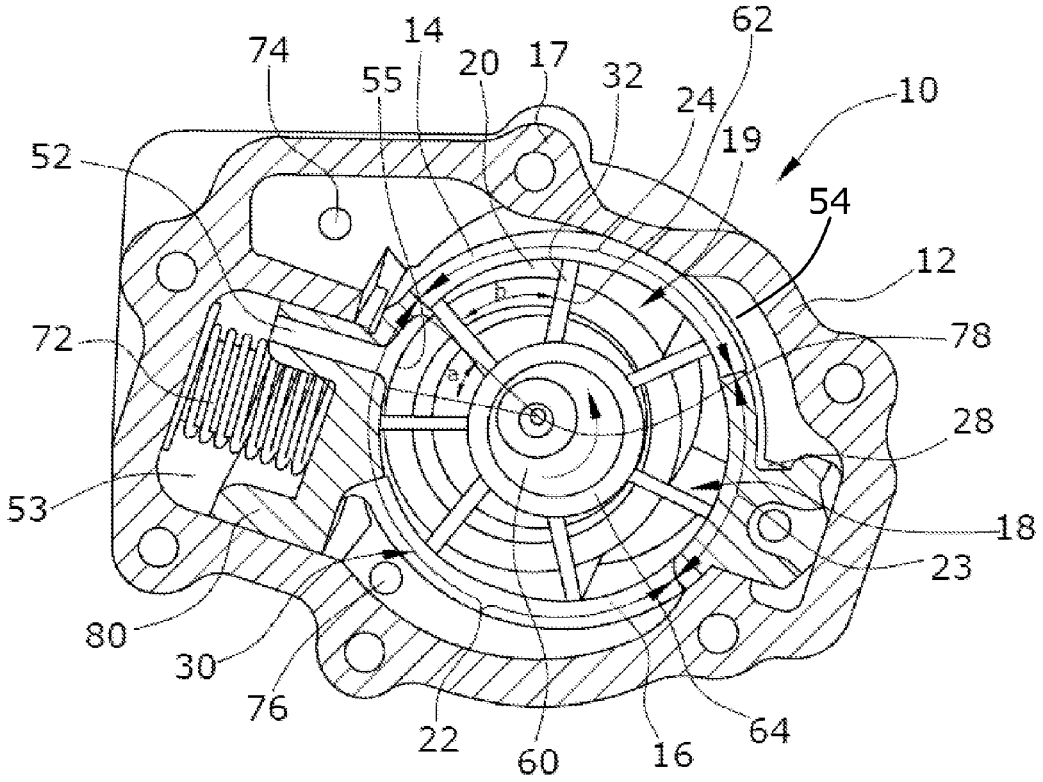
74
14
62
55
20
17
32
24
10
52
19
54
12
72
78
28
53
18
23
80
30
76
22
60
16
64

LUBRICANT VANE PUMP

CROSS REFERENCE TO PRIOR APPLICATIONS

This application is a U.S. National Phase application under 35 U.S.C. § 371 of International Application No. PCT/EP2012/076420, filed on Dec. 20, 2012. The International Application was published in English on Jun. 26, 2014 as WO 2014/094860 A1 under PCT Article 21(2).

FIELD

The present invention relates to a variable lubricant vane pump for providing a pressurized lubricant for an internal combustion engine.

BACKGROUND

A lubricant vane pump is a volumetric pump. The lubricant vane pump is provided with a pump rotor body holding radially slidable vanes rotating inside a shiftable control ring. The slidable vanes, the rotor body, and the walls of the control ring define a plurality of rotating pumping chambers, rotating in a pumping cavity. The pumping cavity is separated into a charge zone with an inlet opening, a discharge zone with an outlet opening, and an intermediate zone between the charge zone and the discharge zone. The intermediate zone is, seen in the direction of rotation, arranged between the charge zone and the discharge zone. The pumping chambers rotate from the charge zone, through the intermediate zone, to the discharge zone inside the control ring. The control ring is radially shiftable for providing an adjustable eccentricity with respect to the static rotor axis. By varying of the eccentricity of the control ring, the control ring is moved between a high pumping volume position and a low pumping volume position, thereby adjusting the pump stroke.

The pump comprises a pretensioning element which pushes the control ring to a high pumping volume direction. The control chamber acts against the pretensioning element. If the rotational speed increases, the pressure in the control chamber rises, so that the control ring is pushed into a low pumping volume direction to keep the outlet pressure constant. If the rotation speed decreases, the outlet pressure decreases as well, so that the control ring is pushed into a high pumping volume direction, with the effect that the lubricant is still pressurized with a more or less constant level independent of the rotational speed of the pump rotor or of the engine.

The lubricant pumped by the lubricant vane pump is incompressible oil. In a cold start action, the state of the art pump control systems lack proper functionality so that the priming time can be too long with respect to the engines' demand. One reason therefor is that the lubricant cannot fill the spring chamber due to its low viscosity, so that the control ring is forced into the low volume direction. Present solutions use high stiffness pretensioning elements to force the control ring into the high volume direction with high forces. However, this solution deteriorates the control quality of the pump in its standard condition (i.e., high temperature performances).

SUMMARY

An aspect of the present invention is to provide an efficient lubricant vane pump with an improved cold start action and with reduced pressure peaks in the cold start action.

In an embodiment, the present invention provides a lubricant vane pump for providing a pressurized lubricant for an internal combustion engine which includes a pump housing configured to enclose a pumping cavity comprising a charge zone and a discharge zone. A control ring is configured to be shiftable and to envelop the pumping cavity. A pump rotor comprising a plurality of vanes divides the pumping cavity into a plurality of pumping chambers. The pump rotor is configured to be radially slidable and to rotate in the control ring from the charge zone to the discharge zone. A spring chamber comprises a pretensioning element. The pretensioning element is configured to push the control ring to a high pumping volume direction. A control chamber is configured so that a lubricant pressure in the control chamber moves the control ring to a low pumping volume direction against a force of the pretensioning element. A pumping cavity outlet port is connected to the control chamber. A pressure equilibration channel is configured to drain the lubricant from the pumping chamber in the discharge zone into the spring chamber.

BRIEF DESCRIPTION OF THE DRAWINGS

The present invention is described in greater detail below on the basis of embodiments and of the drawing in which:

FIG. 1 shows a longitudinal cross section of a lubricant vane pump 10 with an embodiment of an enlarged detail.

DETAILED DESCRIPTION

In an embodiment of the present invention, the lubricant vane pump for providing pressurized lubricant for an internal combustion engine is provided with a pump housing with a pump rotor, whereby the pump rotor is provided with radially slidable vanes rotating in a shiftable control ring. This arrangement defines numerous pumping chambers rotating from a charge zone to a discharge zone, and together define a pumping cavity. A pretensioning element, which is provided in a spring chamber, pushes the control ring to a high pumping volume direction. The lubricant vane pump is furthermore provided with a control chamber, whereby lubricant pressure in the control chamber causes the control ring to be moved to a low pumping volume direction against the pretensioning force of the pretensioning element. The lubricant vane pump is also provided with a pumping cavity outlet port through which the lubricant leaves the rotating pumping chamber in the discharge zone. This pumping cavity outlet port can be provided in the control ring and/or in the pump housing. The lubricant flows from the pumping cavity outlet port to the pump outlet, and from the pump outlet to the engine.

The lubricant vane pump is provided with a pressure equilibration channel to drain the lubricant from the pumping chamber area between the control ring and the rotor in the final emission phase directly into the spring chamber. The pressure equilibration channel is provided with suitable shapes and dimensions.

The position of the channel inlet opening of the pressure equilibration channel is particularly effective where the pumping chamber outlet port is no longer effective. Because of the lubricant discharge into the spring chamber with a high fluid pressure, the control ring is pushed into the high pumping volume direction with a corresponding high pressure.

This feature provides that the pressure peaks in the cold start action of the lubricant vane pump are significantly reduced because the lubricant is drained from the pumping chamber in the final discharge zone into the spring chamber.

This construction design significantly improves the cold start action, thereby reducing the priming time, and allows the use of a low stiffness pretensioning element. With this measure, the high pressure peaks in the cold start action can be significantly reduced without deteriorating the efficiency of the pump. This results in reduced hydraulic noise and a longer pump life-time. The pressure equilibration channel also leads to low total control pressure, thereby improving the total pump efficiency.

A side effect of the pressure equilibration channel is the reduction of pressure peaks, in particular at maximum control ring eccentricity in its high pumping volume position. This reduces hydraulic noise and improves the overall behavior of the pump.

In an embodiment of the present invention, the pressure equilibration channel can, for example, be provided in the control ring. The lubricant connection between the pumping chamber and the spring chamber can be realized by one or more bores in the control ring. The inlet opening of the pressure equilibration channel always moves together with the moving control ring, without changing the opening cross-section of the channel inlet opening.

In an embodiment of the present invention, the pressure equilibration channel can, for example, be provided in the pump housing. This construction provides a simple and compact solution. By providing the pressure equilibration channel in the pump housing, a channel in the control ring can be avoided, so that the control ring is not weakened.

In an embodiment of the present invention, the inlet opening of the pressure equilibration channel, as seen in a direction of rotation, does not, for example, superpose the pumping cavity outlet port in the discharge zone. In the final discharge pumping phase of the pumping chamber, no fluid connection between the pressure equilibration channel and the pumping cavity outlet port exists.

In an embodiment of the present invention, the pretensioning element can, for example, be a mechanical spring. The spring can, for example, be a coil spring. A coil spring is simple, inexpensive and reliable.

In an embodiment of the present invention, the spring chamber can, for example, be provided as a hydraulic chamber which cooperates with the control ring in the direction of the pretensioning element. In other words, the spring chamber supports the effects of the pretensioning element if a relevant lubricant pressure is present in the spring chamber.

In an embodiment of the present invention, the opening angle a of the inlet opening of the pressure equilibration channel can, for example, be between 100% and 20% of the angle b of the rotating pumping chamber. The angle a of the inlet opening of the pressure equilibration channel can, for example, be between 80% and 40% of the angle b. The opening angle of the pressure equilibration cannel should be not too large. The inlet opening of the pressure equilibration channel should not, however, be larger than the pumping chamber angle b.

In an embodiment of the present invention, the inlet opening of the pressure equilibration channel can, for example, be arranged at the reversal point of the control ring in the low pumping position so that the lubricant of the rotating pumping chamber is completely discharged before the pumping chamber rotates/shifts to the charge zone.

A detailed description of an embodiment of the present invention with reference to the drawings is set forth below.

FIG. 1 shows a mechanical lubricant vane pump 10 which can be directly driven by an internal combustion engine (not shown). The lubricant vane pump 10 is part of a lubricant circuit for supplying the internal combustion engine with pressurized lubricant. The lubricant vane pump 10 pumps the lubricant to the combustion engine with a pump outlet pressure.

The lubricant vane pump 10 comprises a housing 12 with a pump inlet port 76 and a pump outlet port 74. The lubricant vane pump 10 is provided with the housing 12 consisting of a main body 17 and two side walls 20 enclosing a pumping cavity 18 of the lubricant vane pump 10. Only the bottom side wall 20 is shown in FIG. 1, whereas the top side wall is removed.

The lubricant is sucked from a lubricant tank into the pumping cavity 18 to the pumping cavity outlet port 14 to feed the lubricant with the pumping outlet pressure to the engine. The pumping cavity 18 is separated, in a circumferential direction, into a charge zone 22, which is provided with the pump inlet port 16, a discharge zone 24, which is provided with the pump outlet port 74, and an intermediate zone 23 between the charge zone 22 and the discharge zone 24.

Inside, the lubricant vane pump 10 is provided with a shiftable control ring 28 and a pump rotor 30 with seven slidable vanes 32. The pump rotor 30 can alternatively be provided with another number of vanes. The pump rotor 30 is provided with a driven rotor hub 60 which is provided with vane slits 62, wherein the slidable vanes 32 are arranged so as to be radially shiftable, which separate seven rotating pumping chambers 19. A support ring 64 is provided in the center of the rotor hub 60 which supports the radially inwards end of the slidable vanes 32. The pump rotor 30 rotates around a static rotor axis 78 in an anti-clockwise direction.

The seven rotating pumping chambers 19 each having a pumping chamber angle b of about 51° as measured from the static rotor axis 78 in a plane which is perpendicular to the static rotor axis 78. Each pumping chamber 19 continuously rotates from the charge zone 22 over the intermediate zone 23 to the discharge zone 24 and back to the charge zone 22.

Inside the control ring 28, a pressure equilibration channel 52 is provided to drain the lubricant from the pumping chamber 19 into the final discharge zone 24 into the spring chamber 53. A bore is disposed in a radial direction in the body of the control ring 28. A channel inlet opening 55 is arranged at the inlet of the pressure equilibration channel 52. The channel inlet opening 55 is orientated to the pumping chamber 19 and is realized as a recess in the control ring 28. The channel inlet opening 55 is arranged at the reversal point of the control ring 28 in the low pumping position. The channel inlet opening 55 of the pressure equilibration channel 52, as seen in direction of rotation, does not superpose the pumping cavity outlet port 14 in the discharge zone 24 and is separated by a small separating portion of the control ring 28. The pumping chamber angle b is about 51°. In the shown embodiment, the angle a of the channel inlet opening 55 is about 30°. Both angles a and b can, however, vary; it is possible that the relation between the angles be between 100% and 40%. Both angles a and b are measured from the static rotor axis 78 in a plane which is perpendicular to the static rotor axis 78.

In an alternative embodiment, the pressure equilibration channel can be provided as an open groove in the control ring 28 and in the pump housing 12, or only in the pump housing 12.

The pressure equilibration channel 52 connects the inside with the outside of the control ring 28, thereby fluidly connecting the pumping chamber 19 with the spring chamber 53. This arrangement leads to a piston/cylinder assembly. The piston element 80 is an integral part of the control ring 28. When the lubricant pressure in the pressure equilibration channel 52 increases, the piston element 80 immediately reacts by a radial shifting to the center so that the space in the spring chamber 53 increases and the control ring 28 is displaced to the center. With increasing lubricant pressure in the pressure equilibration channel 52, the control ring 28 is displaced, the space in the spring chamber 53 increases, and the pumping volume is increased.

When the rotational speed of the engine increases, the pressure in the pumping chambers 19 also increases so that the pressure equilibration channel 52 is filled with lubricant. The lubricant flows from the pressure chamber 19 through the pressure equilibration channel 52 into the spring chamber 53.

If the pressure equilibration channel 52 is filled with lubricant, the pretensioning element 72 holds a constant position at the outlet opening 14 so that the lubricant vane pump 10 is driven with a more or less constant pumping volume, independent of the rotational speed of the lubricant vane pump 10.

The present invention is not limited to embodiments described herein; reference should be had to the appended claims.

LIST OF REFERENCE NUMERALS

10 lubricant vane pump
12 pump housing
14 pumping cavity outlet port
16 pumping cavity inlet port
17 main body
18 pumping cavity
19 pumping chamber
20 side walls
22 charge zone
23 intermediate zone
24 discharge zone
28 control ring
30 pump rotor
32 slidable vanes
52 pressure equilibration channel
53 spring chamber
54 control chamber
55 channel inlet opening
60 rotor hub
62 vane slits
64 support ring
72 pretensioning element
74 pump outlet port
76 pump inlet port
78 static rotor axis
80 piston element

What is claimed is:

1. A lubricant vane pump for providing a pressurized lubricant for an internal combustion engine, the lubricant vane pump comprising:

a pump housing configured to enclose a pumping cavity comprising a charge zone and a discharge zone;

a control ring configured to be shiftable and to envelop the pumping cavity;

a pump rotor comprising a plurality of vanes which divides the pumping cavity into a plurality of pumping chambers, the plurality of vanes being configured to be radially slidable and to rotate in the control ring from the charge zone to the discharge zone;

a spring chamber comprising a pretensioning element, the pretensioning element being configured to push the control ring to a high pumping volume direction;

a control chamber configured so that a lubricant pressure in the control chamber moves the control ring to a low pumping volume direction against a force of the pretensioning element;

a pumping cavity outlet port connected to the control chamber; and a pressure equilibration channel configured to drain the lubricant directly from the pumping chamber in the discharge zone directly into the spring chamber, wherein, the pump rotor comprises a static rotor axis, the pressure equilibration channel comprises a channel inlet opening, the discharge zone comprises a pumping cavity outlet port, the channel inlet opening does not overlap with the pumping cavity outlet port when seen along the static rotor axis, the channel inlet opening comprises an opening angle as measured from the static rotor axis in a plane which is perpendicular to the static rotor axis, the plurality of pumping chambers comprise a pumping chamber angle as measured from the static rotor axis in the plane which is perpendicular to the static rotor axis, and a size of the opening angle of the channel inlet opening is between 100% and 20% of a size of the pumping chamber angle.

2. The lubricant vane pump as recited in claim 1, wherein the pressure equilibration channel is arranged entirely in the control ring.

3. The lubricant vane pump as recited in claim 1, wherein the pressure equilibration channel is arranged entirely in the pump housing.

4. The lubricant vane pump as recited in claim 1, wherein the size of the opening angle of the channel inlet opening is between 80% and 40% of the size of the pumping chamber angle.

5. The lubricant vane pump as recited in claim 1, wherein the channel inlet is arranged at a reversal point of the control ring in a low pumping position.

6. A lubricant vane pump as recited in claim 1, wherein the pretensioning element is a spring.

7. The lubricant vane pump as recited in claim 6, wherein the spring is a coil spring.

8. The lubricant vane pump as recited in claim 1, wherein the spring chamber is provided as a hydraulic chamber, the spring chamber being configured to cooperate with the control ring in a direction of the pretensioning element.

* * * * *